United States Patent [19]

Bickford

[11] Patent Number: 4,596,435

[45] Date of Patent: Jun. 24, 1986

[54] CAPTIVATED LOW VSWR HIGH POWER COAXIAL CONNECTOR

[75] Inventor: Wayne F. Bickford, East Hampstead, N.H.

[73] Assignee: Adams-Russell Co., Inc., Amesbury, Mass.

[21] Appl. No.: 593,598

[22] Filed: Mar. 26, 1984

[51] Int. Cl.[4] ..... H01R 17/04

[52] U.S. Cl. ..... 339/177 R

[58] Field of Search ..... 339/177 R, 177 E; 174/75 C, 88 C, 89; 333/260

[56] References Cited

U.S. PATENT DOCUMENTS

| | | | |
|---|---|---|---|
| 2,860,316 | 11/1958 | Watters et al. | 174/75 C |
| 2,952,823 | 9/1960 | Robinson | 339/177 R |
| 3,437,960 | 4/1969 | Ziegler, Jr. | 174/75 C |
| 3,673,546 | 6/1972 | Green et al. | 339/177 R |
| 4,035,054 | 7/1977 | Lattanzi | 339/177 R |
| 4,374,606 | 2/1983 | Lathrop | 339/177 R |

*Primary Examiner*—Neil Abrams

*Attorney, Agent, or Firm*—St. Onge Steward Johnston & Reens

[57] ABSTRACT

The subject invention is directed to a coaxial connector or interseries adapter comprising of at least one metallic center conductor, an insulating captivation bead surrounding said center conductor and at least one metallic coaxial sheath disposed in coaxial relationship to said at least one center conductor. The captivation bead imparts a dramatic increase in mechanical strength to the connector or adapter preventing axial or radial movement of the center contact, in relation to the outer contact, when differential forces are applied between the center and outer contact. The captivation bead in the coaxial connector or adapter can be matched to achieve a low VSWR. Surprisingly the captivation bead allows a dramatic increase in power handling capability.

21 Claims, 15 Drawing Figures

CAPTIVATED LOW VSWR HIGH POWER COAXIAL CONNECTOR

The present invention relates to an improved connector or interseries adapter having utility as a means of connecting a transmission line to a second transmission line or to an electronic device. The unique captivation bead used in the subject invention creates principally a dramatic increase in mechanical strength which restricts movement of the pin when longitudinal forces are applied axially to the center conductor relative to the outer coaxial sheath and a secondary mechanical strength improvement in restricting radial movement of the pin when radial forces are applied. The said captivation bead is matched to achieve a low VSWR and surprisingly the addition of the captivation bead to said coaxial connector or interseries adapter allows a dramatic increase in the power handling capability of said connector.

Numerous types of connectors and interseries adapters exist for coaxial cable. Connectors and adapters also are known for cable which have a plurality of conductors and may have a surrounding outer coaxial sheath. Generally they are characterized as coaxial connectors, coaxial interseries adapters, multi-conductor connectors and multi-conductor interseries adapters. Most commonly these connectors employ a dielectric material, between said center conductor(s) and said outer coaxial sheath, which has low mechanical strength. Said dielectric materials are commonly TEFLON TM (polytetrafluoroethylene) or polystyrene. Longitudinal and/or radial forces that are transferred to the contacts in the connector create longitudinal and/or radial displacement of the center contact(s), which degrades the transmission of the RF energy through these connectors. Some coaxial connectors or interseries adapters in the prior art have employed devices, commonly referred to as captivation beads, to impart added mechanical strength which prevents longitudinal and/or radial movement of the center conductor.

Many individuals skilled in the art have measured the improvement in performance that has been achieved by the prior art so called captivation beads and have found that even though an increase in mechanical strength is achieved, commonly the microwave transmission of RF energy is degraded. It is also known that the prior art captivation beads do have a limit to their mechanical strength and this limitation is imparted to the connector design. A further problem which plagues coaxial connectors and/or interseries adapters, is power handling capability; commonly the coaxial connector and/or interseries adapter is the weakest link in the transmission path and as is well-known, by those skilled in the art, captivation beads typically derate their power handling capability.

In view of these and other disadvantages and deficiencies in existing coaxial connectors, and/or captivation beads, and/or interseries adapters, it is an object of the present invention to provide an improvement in coaxial connectors, their captivation beads and interseries adapters, which increase their mechanical strength, thereby preventing movement of the center contact in response to the outer contact resulting from longitudinal and/or radial forces applied relatively between their inner and outer contacts.

Still another object of the invention is to achieve an improvement of mechanical strength without degrading the power handling capability of the connector. Surprisingly it was found that with captivation beads manufactured in accordance with the present invention, coaxial connectors and coaxial interseries adapters have a dramatic increase in their power handling capability. Therefore, the objects of the invention not only were accomplished but were surpassed due to the increase in power handling capability achieved, over and above prior art connectors.

These objects and advantages are achieved by an improved coaxial connector, and/or coaxial interseries adapters, comprising of at least one center conductor, with a first longitudinal portion surrounded by a dielectric core, and a second longitudinal portion surrounded by a captivation bead and containing at least one outer coaxial sheath disposed along the length of said dielectric core and captivation bead. Virtually all types and numbers of center conductors (contacts), dielectrics and outer coaxial sheaths (outer contact) known to those skilled in the art may be used in the coaxial connector of the present invention.

Thus, there may be more than one center conductor which may be disposed in a straight or in a helically or twisted arrangement within the dielectric core. Any of various known materials for construction of center contacts in connectors may be employed such as copper, beryllium, silver-plated copper, aluminum, and other materials. The dielectric which surrounds the center contact, may be composed of air, a polymer material such as polytetrafluoroethylene, polyethylene, polystyrene, composites, laminates and other materials or combinations of materials conventionally employed as dielectrics in coaxial connectors.

In accordance with the present invention, a longitudinal section of the dielectric core is replaced with a unique captivation bead. The captivation bead acts as a dielectric between the center conductor and outer coaxial sheath and additionally is designed to impart added mechanical strength to prevent radial and/or longitudinal movement of the center contact in respect to the outer coaxial sheath. The design of the captivation bead and/or adjacent dielectric core material is such that a low VSWR is achieved as a result of impedance matching at the transition of dielectric materials and captivation bead as well as a match throughout the length of the captivation bead. Preferably the dielectric core and/or captivation bead positions the center contact coaxially with the longitudinal axis of the cable. The center contact or contacts may be concentric or eccentric within the outer coaxial sheath depending upon their position in the dielectric. In a coaxial connector or interseries adapter, it is preferred to have the center contact positioned along the central longitudinal axis. Therefore the center contact typically will be concentric (e.g. coaxial) within the outer coaxial sheath.

The unique captivation bead of the invention may be constructed from any convenient material used as a dielectric in coaxial connectors. However, it is preferred to use an electrically good dielectric material that has mechanical strength that surpasses material such as TEFLON TM (polytetrafluoroethylene) or polystyrene. The material in the captivation bead most preferably is boron nitride to impart the ultimate mechanical strength, yet maintain low VSWR and low adsorption of microwave energy transmitted through the coaxial connector. However other materials such as VESPEL TM (polyimide) may be used. The unique captivating bead of the invention allows designing the connector with inner and outer conductors of a constant diameter, allowing use of less critical electrical offsets. As a result, the impedance mismatch and attenuation of transmittal energy is less than that of the prior art. Surprisingly, it has also been found that the captivation bead, in accordance with the present invention, imparts a dramatic increase in the power handling capability of both coaxial connectors and coaxial interseries adapters.

The dielectric bead and captivation bead is surrounded by an outer coaxial sheath. The outer coaxial sheath may be any of the various known materials for construction of outer contacts in connectors such as copper, aluminum, steel, beryllium and other materials.

In manufacturing the connector or interseries adapters of the invention, the components of the connector are machined and assembled in accordance with known techniques used by those skilled in the state-of-the-art. Further details of the manufacture of the preferred embodiments of the invention are discussed below.

Numerous other features, objects and advantages will become apparent from the following specification when read in connection with the accompanying drawing in which.

The following description illustrates the manner in which the principles of the invention are applied, but is not to be construed as limiting the scope of the invention.

Figure 1:
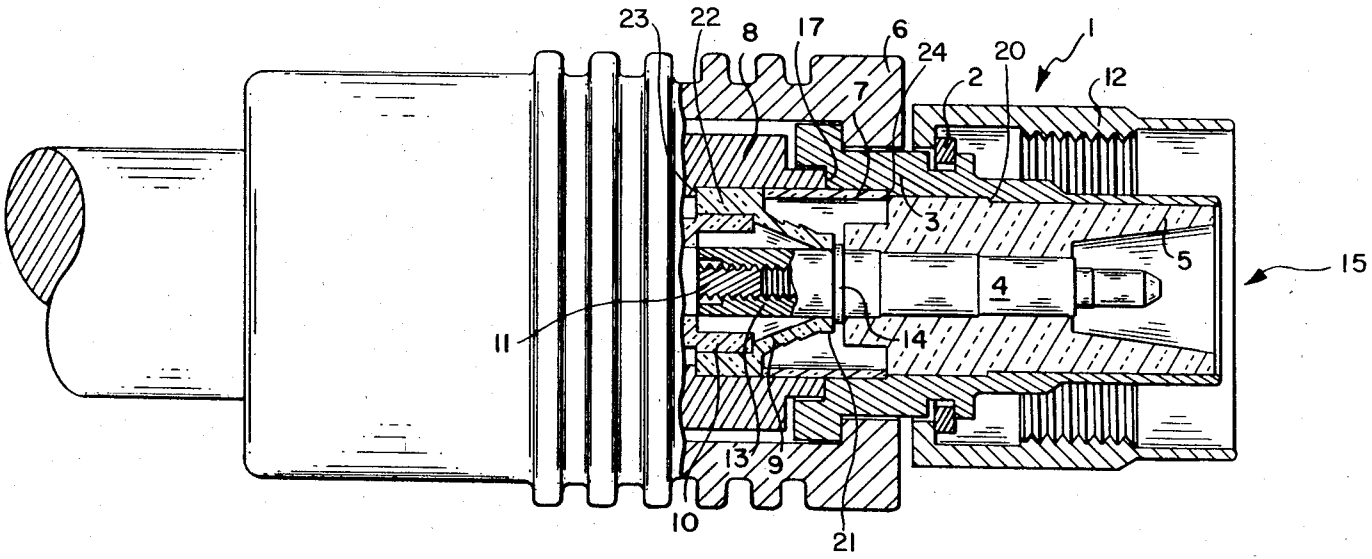
FIG. 1 shows an SC coaxial cable connector with a novel captivation bead according to the invention.

FIG. 1 shows an SC coaxial cable connector embodiment of the invention. The coaxial connector 1 includes a center conductor (contact) 4, which is connected via a threaded junction 13 to the cable center conductor 11. The center contact 4 is surrounded by a cylindrical layer of dielectric or insulating material 5, which is preferably TEFLON TM (polytetrafluoroethylene) and axially seated against raised step 14 of the inner conductor and an inwardly extending edge 20 of outer conductor 3. A second section of TEFLON TM (polytetrafluoroethylene) dielectric 7 surrounds center contact 4 adjacent to said dielectric and axially overlaps the raised step 14 5. Adjacent to said dielectric 7 is a captivation bead 9 adjacent to the step 14 in center conductor 4. Preferably the captivation bead 9 is manufactured from a high heat conductive high mechanical strength and electrically good insulative material such as boron nitride or VESPEL TM (polyimide). The bead 9 has a smaller annular rim 21 that is seated against the raised step 14 of the inner conductor and on the axial side thereof that is opposite to the side against which insulator 5 is seated. The larger annular rim 22 of bead 9 is seated against an inwardly extending edge 23 of a generally even inner surface of outer conductor 3. The bead 9 is inhibited from axial movement by effectively seating its larger rim 22 against inwardly extending edge 24 of outer conductor 3 via the ring insulator 7. Edge 24 faces axially opposite to the direction of edge 23; hence, axially locking bead 9 into place with respect to the outer conductor. A third dielectric member 10 surrounds said center contact 4 and said cable center conductor 11 and is adjacent to the inner surface of said captivation bead 9. Preferably said dielectric 10 is manufactured from TEFLON TM (polytetrafluoroethylene). An outer coaxial metallic sheath 3 surrounds said dielectrics 5 and 7. Said outer contact 3, dielectric 5, and center contact 4 create an electrical SC male interface for the connector 15 which is designed in accordance with MIL-T-81490AS. Adjacent to outer contact 3 is a second outer metallic coaxial sheath 8 which surrounds said captivation bead 9 and makes electrical contact to the outer coaxial sheath of the cable 16. An outer metallic member 6 holds the two outer coaxial sheaths 3 and 8 in electrical contact at their connection 17. A snap ring 2 retains the coupling nut 12 on the outer coaxial sheath 3. The mechanical strength of the captivation bead 9 is preferably greater than that of the dielectric members so that a greater force is required to fracture the latter than the former.

Figure 2:
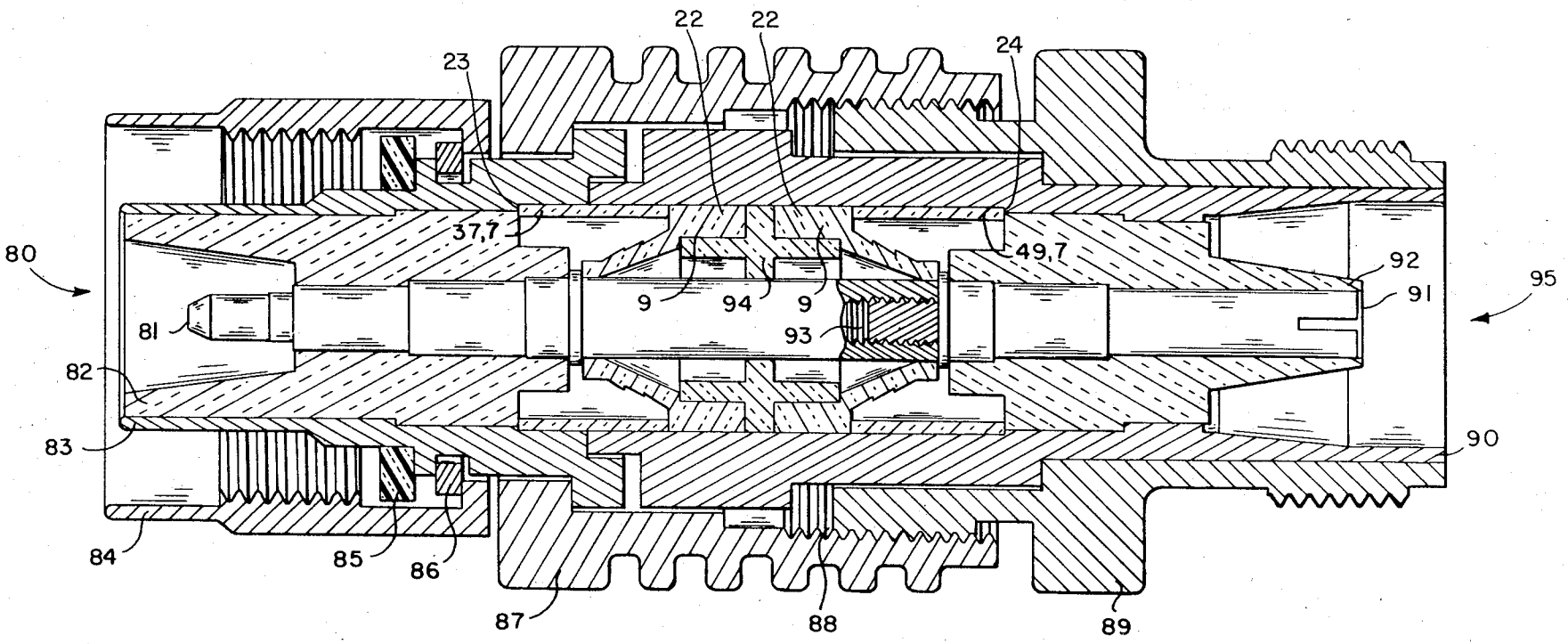
FIG. 2 shows a coaxial interseries adaptor with a captivation bead according to the invention.

Referring to FIG. 2, there is shown a coaxial interseries adaptor according to the invention. The SC male 80 and female 95 interfaces on the adapter are dimensioned in accordance with MIL-T-8049OAS. The inner series adapter includes a center contact 81 typically made of gold plated beryllium copper, a TEFLON TM pin support 82, a contact finger 83, a coupling nut 84, a gasket 85, a snap ring 86, a clamping nut 87 and a threaded joint 88 with the SC female outer housing 89. The female end includes an outer conductor 90, an SC female basket 91 typically made of gold plated beryllium copper, a basket support 92 typically made of TEFLON TM, a threaded joint 93 with the inner conductor, a TEFLON TM bead 94, support beads 7, 37 and 47 typically made of TEFLON TM and a captivating bead 9 typically made of boron nitride. Typical materials include silver plated beryllium copper for outer conductor 90 and corrosion resistant stainless steel (cres) for coupling nut 84, clamping nut 87 and SC female outer housing 89. Gasket 85 is typically made of silicon rubber and snap ring 86 of silver plated beryllium copper. Axial locking of the captivating beads 9 is obtained with rings 37, 49 which are seated against edges 23,24 of outer conductor 90.

A significant improvement is obtained in the ability to withstand longitudinal forces applied relatively between the center and outer contacts in the interseries adapter; tests on captivation beads designed similarily to that shown in FIG. 2 indicate that a 150 lb axial force may be applied in either direction to the center contact relative to the outer contact without significant change in the interface dimensions whereas prior art connectors, even with prior art captivation beads, would only withstand an order of magnitude less longitudinal force. The design of the dielectrics, inner and outer contacts create an impedance match at the transition into and out of the beads, and throughout their length to help achieve a very good match and appropriately low VSWR, typically less than 1.2:1 up to 10 GHz, which is the upper frequency limit of the SC interfaces. These captivation beads have been proven to work in excess of 18 GHz. Measurements show that, utilizing the unique captivation bead of the invention, 1800 watts of average power can be transmitted through the adapter while subjected to an altitude of 70,000 feet and a temperature of 130° C. whereas, prior art SC interseries adaptors would only handle 1200 watts at 70,000 series and 130° C. with both measurements performed at 2.5 GHz.

The improvements exhibited are not necessarily limited to radially symmetric designs. Those skilled in the art will recognize that while a radially asymmetric design is not usually a preferred embodiment, there can be occasions that necessitate a radially asymmetric design which is an embodiment of this invention.

Figure 3:
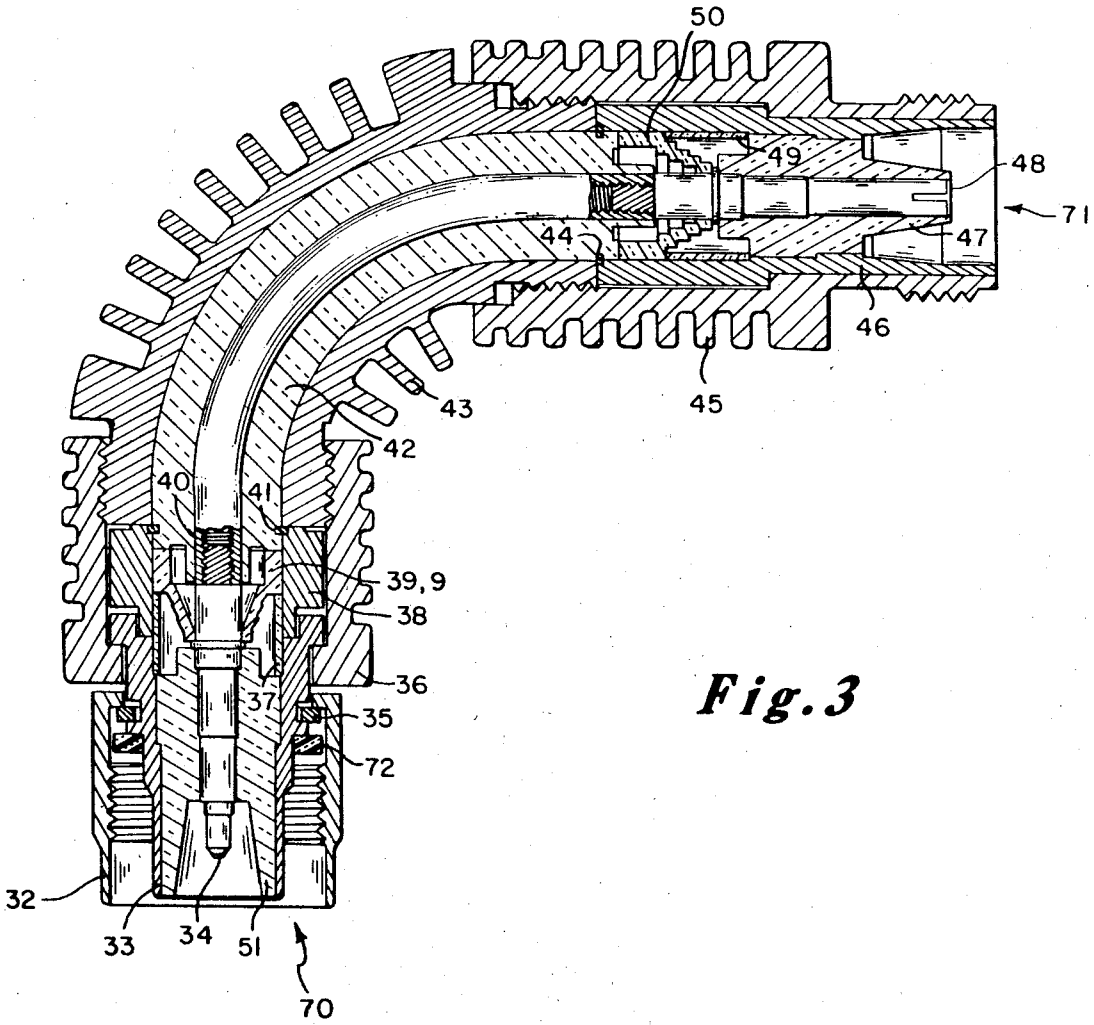
FIG. 3 shows another interseries adapter which has a right angle configuration and is designed in accordance with the invention in which two unique captivation beads are used in offset and opposing directions and having unique high strength dielectric snap rings to captivate dielectric materials used between center and outer conductors.

Referring to FIG. 3, there is shown a lengthwise sectional view of an interseries adapter according to the invention having right angle bend. An SC male input 70 is at one end and an SC female in input 71 at the other meeting MIL-T-8149OCAS specifications. This embodiment includes a coupling nut 32, contact finger 33, center contact 34, pin support 51, silicon rubber moisture seal 72, snap ring 35, clamping nut 36, dielectric spacer 37, outer conductor 38, captivating bead 39, center conductor 40, snap ring 41 and a center conductor support 42. An angular housing 43 intercouples the assembly at end 70 with the assembly at end 71 having a snap ring 44, a clamp nut 45, an outer conductor 46, a basket support 47, a female basket 48 and a support bead 49. Typical materials include cres stainless steel for the coupling and clamping nuts, silver plated beryllium copper for contact fingers 33, snap ring 35, outer conductor 38, angular housing 43 and outer conductor 46. Gold plated beryllium copper may be used for center contact 34, center conductor 40 and female basket 48. TEFLON TM may be used for dielectric spacer 37, center conductor support 42, basket support 47, support bead 49 and pin support 51. Boron nitride may be used for captivating bead 39. VESPEL TM may be used for snap rings 41 and 44.

Figure 4:
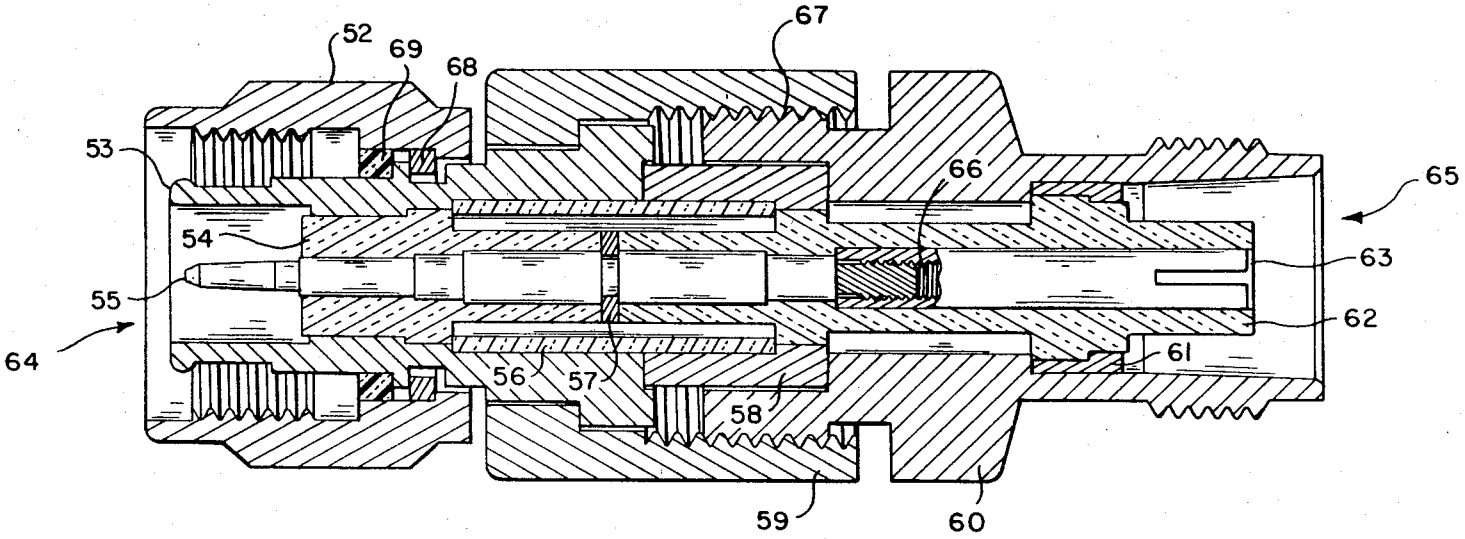
FIG. 4 shows another interseries adapter in accordance with the invention which utilizes a high strength dielectric snap ring to captivate the dielectric material between the center and outer conductors.

Referring to FIG.4, there is shown another embodiment of an interseries adapter according to the invention having a TNC male input 64 and TNC female input 65 meeting MIL-T-81490(AS) specifications. This embodiment of the invention includes a coupling nut 52, contact finger 53, pin support 54, center contact 55, dielectric spacer 56, snap ring 57, outer conductor 58, clamping nut 59, TNC female housing 60, retaining sleeve 61, basket support 62, basket 63, threaded junction 67, snap ring 68 and silicon rubber moisture seal 69. Cres stainless steel is typically used for coupling nut 52, clamping nut 59, TNC female housing 60 and retaining sleeve 61. Silver plated beryllium copper is typically used for contact finger 53, outer conductor 58 and snap ring 68. Gold plated beryllium copper is typically used for center contact 55 and basket 63. TEFLON TM is typically used for pin support 54, and basket support 52. VESPEL TM is used for snap ring 57.

Figure 5A:
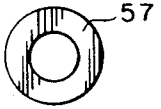
FIGS. 5A and 5B show a detail of the snap ring of FIG. 4.
Figure 5B:
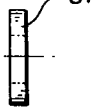

Referring to FIGS. 5A and 5B, there are shown plan and side views, respectively, of snap ring 57.

Figure 6:
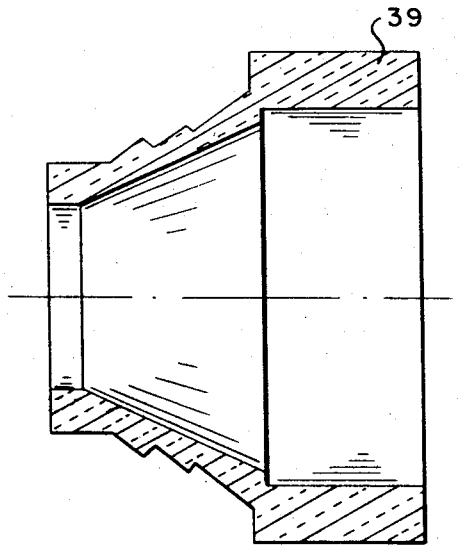
FIG. 6 shows a detail of the unique captivation bead shown in FIGS. 1–3.

Referring to FIG. 6, there is shown an axial sectional view of captivating beads, such as 9 and 39, showing its generally flowerpot shape and the indentations of sawtooth cross section. This bead may be regarded as having an annular rim at each end radially displaced and intercoupled by a stepped portion.

Figure 7:
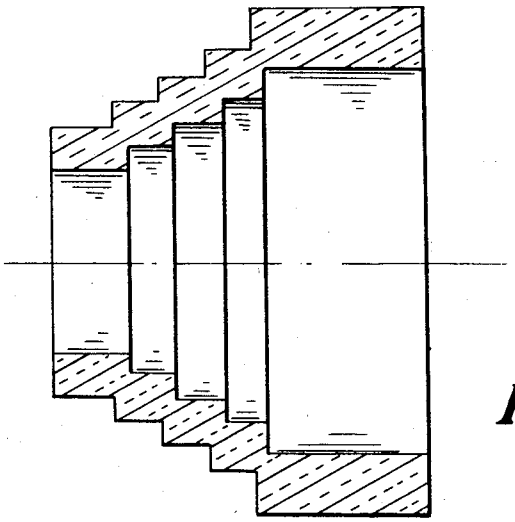
FIG. 7 shows a stepped cavitation bead.

Referring to FIG. 7, there is shown an alternate embodiment of the captivation bead corresponding substantially to bead 50 having perpendicular steps.

Figure 8A:
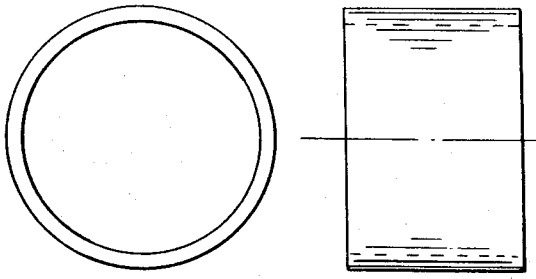
FIGS. 8A and 8B show a detail of a dielectric spacer shown in FIGS. 1–3.
Figure 8B:
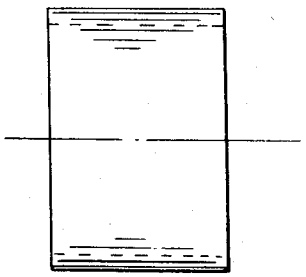

Referring to FIGS. 8A and 8B, there are shown plan and elevation views, respectively, of dielectric spacers, such as 7, 37 and 49.

Figure 9B:
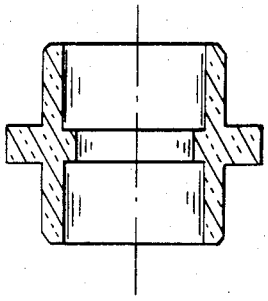
FIGS. 9A and 9B show a detail of a bead shown in FIG. 2.
Figure 9A:
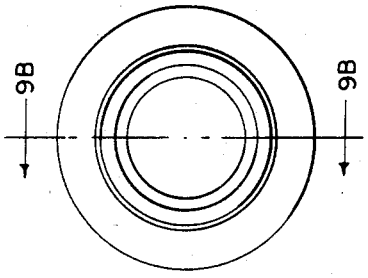

Referring to FIGS. 9A and 9B, there are shown plan and axial sectional views, respectively, of bead 94 of FIG. 2.

Figure 10B:
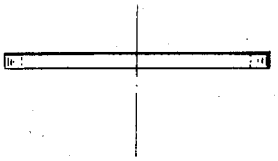
FIGS. 10A and 10B show a detail of snap rings shown in FIG. 3.
Figure 10A:
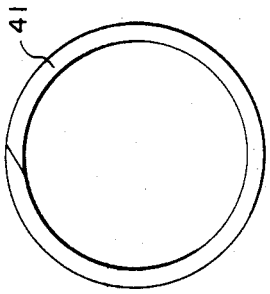

Referring to FIGS. 10A and 10B, respectively, there are shown plan and elevation views, respectively, of snap rings 41 and 44 of the embodiment of FIG. 3.

Figure 11:
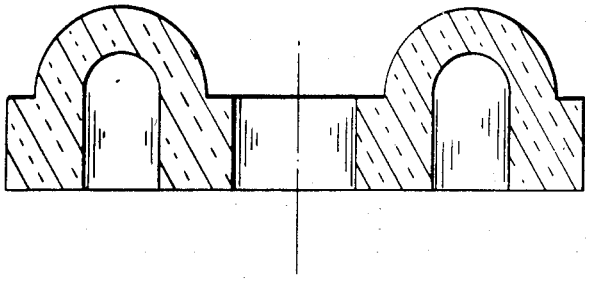
FIG. 11 shows a detail of another captivation bead.

Referring to FIG. 11, there is shown an axial sectional view of an alternate embodiment of the captivation bead in which the radially outward and radially inward annular rims are in axial alignment and interconnected by portions of generally U-shaped cross section in a radial plane.

The coaxial connectors, and/or interseries adapters may take the form of numerous different embodiments in forming transmission line portions. Though the invention has been illustrated by coaxial cable connectors and/or coaxial interseries adapters, other coaxial interconnecting devices may be used in forming an interconnection in accordance with the invention. These captivation elements, such as beads and snap rings, may be used in a cable to captivate the cable components. Different devices on either or both sides of either the novel captivation snap ring, or the novel captivation beads, may be used to create an interconnecting device which interconnects two transmission paths and achieves one or more of the objects of the invention. The novel captivation devices thereby achieve a high mechanical strength in resistance to differential longitudinal forces applied between the center and outer conductors and as a secondary effect, increases the resistance to radial movement as a result of differential radial forces applied between center and outer conductors. Surprisingly the novel captivation bead also allows transmission of a significantly higher power level through the device. These achievements are obtained while maintaining a low VSWR as a result of good impedance match throughout the coaxial transmission path.

While the invention has now been described in terms of certain preferred embodiments and exemplified with respect thereto, those skilled in the art will readily appreciate that various modifications, changes, omissions and substitutions may be made without departing from the spirit of the invention. Consequently, the invention is to be construed as embracing each and every novel feature and novel combination of features present in or possessed by the apparatus and techniques herein disclosed and limited by the spirit and scope of the appended claims.

What is claimed is:

1. A coaxial connector capable of high power RF (radio-frequency) transmission along a longitudinal axis and using a low VSWR captivating bead, comprising:

an inner conductor and an outer conductor surrounding said inner conductor to form an RF coaxial transmission line;

said inner conductor having a radially raised step with first and second faces oppositely directed along said axis;

said outer conductor having a substantially even inner surface along its length and being interrupted with integral edges oriented to restrain axial movement of the captivating bead and inner conductor;

means for coaxially supporting and axially restraining said inner conductor, said means including a captivating bead having a flower pot-like shape formed with a funnel-like wall portion including inner and outer surfaces that are axially tapered in the same direction between differently sized annular rims at opposite axial ends; the smaller of said rims enclosing the inner conductor with radial support thereof and being effectively axially seated against the first face of the raised step of the inner conductor; the larger of said rims being effectively seated against one of said outer conductor edges, said captivating bead being formed of a material that is mechanically strong; and insulating means surrounding the inner conductor and effectively seated against the second face of the raised step and against another of said edges of the outer conductor to restrain, in cooperation with the captivating bead, the inner conductor against axial motion in either direction along said axis with the raised step clamped between the captivating bead and the insulating means.

2. The coaxial connector as claimed in claim 1 wherein the captivating bead is formed of a high heat conductive insulating material.

3. The coaxial connector as claimed in claim 1 wherein said captivating bead is formed of boron nitride.

4. The coaxial connector as claimed in claim 1 wherein said captivating bead is made of a material selected from the group consisting of boron nitride and polyimide.

5. The coaxial connector as claimed in claim 1 wherein the inner conductor has a second raised step which is axially spaced from the first step, and wherein said means for coaxially supporting and restraining the inner conductor includes a second captivating bead like said first captivating bead, the smaller rim of the second captivating bead surrounding the inner conductor and being effectively seated against the second raised step; the larger rim of the second captivating bead being effectively seated against another one of said outer conductor edges; and with said first and second captivating beads being oriented in opposite directions.

6. The coaxial connector as claimed in claim 5 wherein said inner conductor has first and second spaced-apart raised steps, with the smaller rims of said first and second captivating beads being respectively directly seated against said first and second raised steps.

7. The coaxial connector as claimed in claim 6 and further including an insulating bead placed between and in contact with the larger annular rims of the first and second captivating beads and surrounding the inner conductor.

8. The coaxial connector as claimed in claim 7 wherein the bead between the larger rims is made of polytetrafluoroethylene and said first and second captivating beads are formed of boron nitride.

9. The coaxial connector as claimed in claim 1 and further including an annular insulating ring placed adjacent to the outer conductor and seated between the larger rim of the captivating bead and said one edge of the outer conductor and being located so as to axially overlap said raised step of the inner conductor.

10. The coaxial connector as claimed in claim 1 and further including second insulating means between the inner and outer conductors and having a snap-ring receiving recess and an insulator snap-ring operatively placed in contact with a said edge of the outer conductor and with said recess in the second insulating means to captivate it to said outer conductor.

11. The coaxial connector as claimed in claim 10 wherein said snap-ring is formed of polyimide material.

12. The coaxial connector as claimed in claim 1 wherein the captivating bead has at least first and second annular steps of generally sawtooth shape in crossection and located between the smaller and larger rims of the captivating bead.

13. The coaxial connector as claimed in claim 12, wherein the captivating bead is formed of boron nitride.

14. The coaxial connector as claimed in claim 1 wherein said bead has a tapered interconnected portion between the rims and forms an angle with said longitudinal axis that is less than 30 degrees.

15. The coaxial connector as claimed in claim 1 wherein said bead has a tapered interconnected portion between said rims and wherein the radial thickness of said tapered interconnecting portion is less than the radial thickness of said larger rim.

16. The coaxial connector as claimed in claim 15 wherein the radial thickness of said smaller rim is less than that of said larger rim.

17. The coaxial connector as claimed in claim 16 wherein the axial length of said smaller rim is less than that of said larger rim.

18. The coaxial connector as claimed in claim 1 wherein the radial thickness of said smaller rim is less than that of said larger rim.

19. The coaxial connector as claimed in claim 8 wherein said bead has a tapered portion interconnecting said rims and wherein the radial thickness of said tapered portion is less than that of said larger rim.

20. The coaxial connector as claimed in claim 19 wherein the axial length of said tapered portion is of the order of the axial length of said smaller and larger rims.

21. The coaxial connector as claimed in claim 17 wherein said tapered interconnected portion is formed with notches of sawtooth axial cross section.

* * * * *